United States Patent [19]

Stoecklein

[11] Patent Number: 4,928,447

[45] Date of Patent: May 29, 1990

[54] CRYPT INSULATION PANEL AND METHOD OF INSTALLATION

[76] Inventor: Walter Stoecklein, 293B, R.D. #2, Rte. 910, Cheswick, Pa. 15024

[21] Appl. No.: 276,948

[22] Filed: Nov. 28, 1988

[51] Int. Cl.[5] ..... E04A 13/00

[52] U.S. Cl. ..... 52/136; 52/134; 52/282

[58] Field of Search ..... 52/134, 135, 136, 133

[56] References Cited

U.S. PATENT DOCUMENTS

| | | | |
|---|---|---|---|
| 892,458 | 7/1908 | Sparks . | |
| 3,213,576 | 10/1965 | Davies | 52/134 |
| 3,925,944 | 12/1975 | Pickel | 52/134 |
| 3,978,627 | 9/1976 | Booth | 52/134 X |
| 4,073,100 | 2/1978 | DiGiovanni, Jr. | 52/136 X |
| 4,204,020 | 5/1980 | Beale et al. | 428/314.8 |
| 4,288,952 | 9/1981 | Work | 52/138 |
| 4,387,491 | 6/1983 | Schaaf et al. | 27/35 |
| 4,727,632 | 3/1988 | Yearsley . | |
| 4,754,587 | 7/1988 | Glaser | 52/282 |

*Primary Examiner*—David A. Scherbel
*Assistant Examiner*—Creighton Smith
*Attorney, Agent, or Firm*—Webb, Burden, Ziesenheim & Webb

[57] ABSTRACT

A crypt insulation panel is made of closed cell polyurethane and placed over an open front of a crypt. The panel is mounted to the crypt by the use of a non-water soluble sealant or polyurethane foam. Further, the panel has an R value of at least 7 and has at least 85% closed cells. A fumigant or a perfume can be added to the panel.

28 Claims, 2 Drawing Sheets

CRYPT INSULATION PANEL AND METHOD OF INSTALLATION

BACKGROUND OF THE INVENTION

1. Field of the Invention

This invention relates generally to mausoleums having viewing areas and a plurality of open-faced crypts arranged in tiers and in side-by-side relationship and, more particularly, to a front panel for the crypts to seal and cover the opened faces and insulate the viewing area of the mausoleum.

2. Description of the Prior Art

Historically, mausoleums have been employed to preserve the remains of man. Today, mausoleums are popular because of the limited amount of space in many urban and suburban areas. Further, mausoleums enable loved ones to visit the deceased at any time of year without braving the cold, rain or snow as is the case with a grave site.

Typically, mausoleums are large buildings having aisles defined by crypts in side-by-side relationship arranged in tiers and formed by a plurality of horizontal and vertical concrete walls. Usually the crypts have an open front prior to placing a casket therein. Each crypt also has a vented back wall with the vents leading to the outdoors so that odors and moisture can escape to the atmosphere when a deceased is placed therein.

Once a casket is placed within the crypt, the crypt is sealed. First, a 1/16" thick polyethylene sheet can be placed over the crypt front. This sheet forms a vapor barrier between the mausoleum aisle and the crypt. A marble or a concrete facing is then mounted over the crypt front. Finally, a plaque can be placed on the facing identifying the deceased.

Since the crypt of the deceased can be viewed at any time of year, the viewing area of the mausoleum must be climatically controlled—air conditioned during the summer months and heated during the winter months. Utility bills can be in the tens of thousands of dollars per year because: (1) the mausoleums are poorly insulated, if at all; (2) the mausoleum outer walls are concrete or masonry, a poor insulator; and (3) the open crypts are vented to the outdoors allowing heated and cooled air to escape. Further, the closed crypts, at best, have a 1/16" sheet of polyethylene and a concrete or marble facing. This affords little insulation to the mausoleum aisles.

U.S. Pat. No. 4,727,632 to Yearsly discloses a method to enclose a casket with a polyethylene shroud in an attempt to insulate a mausoleum. This shroud contains the odors of the decomposing body but provides minimal insulation to the mausoleum because the polyethylene shroud is thin. Further, it is bulky and expensive to manufacture.

Therefore, it is an object of the present invention to provide an inexpensive, lightweight and simple device to seal and insulate the crypts from the viewing aisle and insulate the same.

It is yet another object of my invention to retrofit easily and inexpensively existing mausoleums with the device.

It is yet another object of my invention to have a simple method to install the device.

SUMMARY OF THE INVENTION

My invention is an improvement of existing mausoleums having a plurality of horizontal and vertical walls arranged to provide open-front crypt tiers in side-by-side relationship. My improvement includes a closed cell hydrophobic foam insulation panel for covering the open faces of the crypts. The panels are attached using sealant to the opened faces of the crypts. The panels can be made of polyurethane foam or phenolic foam, although preferably polyurethane foam. Preferably the sealant is impervious to liquids and is hyrdrophobic, and can be silicon based or more preferably closed cell polyurethane foam.

Preferably, when polyurethane foam seals the crypts and attaches the front panels thereto, the panel is first placed over the open face of the crypt and then the polyurethane foam is sprayed forming a seal between the crypt and the mausoleum aisle.

Preferably the polyurethane foam panel has at least 85% closed cells, and the panel has an R value of at least 6 per inch of panel thickness and an R value range of between 7 and about 14 per panel.

DESCRIPTION OF THE PREFERRED EMBODIMENTS

Figure 1:
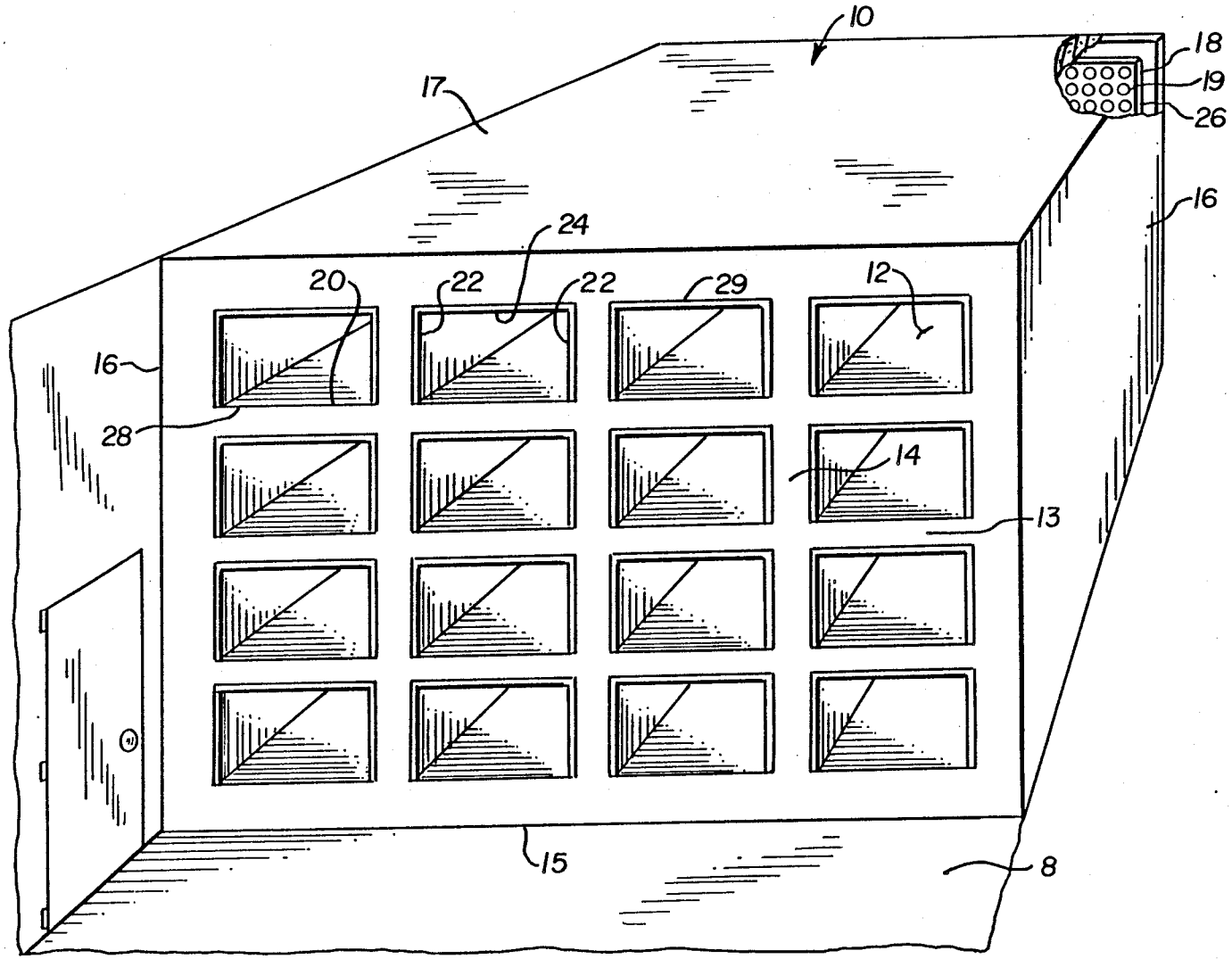
FIG. 1 shows a partial view of a mausoleum aisle and a crypt tier partially in section.

FIG. 1 shows a partial view of a mausoleum aisle 8 and a rectangular tier section 10 of open rectangular faced crypts. Section 10 includes a plurality of crypts 12 formed by a plurality of concrete horizontal walls 13 and a plurality of concrete vertical walls 14 arranged to provide crypts 12 in side-by-side relationship. Each crypt tier section 10 has a crypt tier bottom wall 15, crypt tier sidewalls 16, a crypt tier roof 17 and a crypt tier rear wall 18 having vents 19 passing therethrough. Vents 19 permit air to flow from sealed crypts 12 to the outdoors by convection, thereby, removing any odors and moisture contained therein.

Each crypt 12—formed by a combination of rear wall 19, and horizontal walls 13, vertical walls 14, bottom wall 15, side walls 16 and/or roof 17—includes a floor 20, crypt side walls 22, ceiling 24, a vented back wall 26 and an open front 28. Each crypt 12 also has formed therein a three sided U-shaped offset 29 adjacent to the crypt open front 28. Each crypt's 12 dimensions typically are 30" wide by 25" high and sufficient in length to receive a casket; offset 29 is typically ¾"—1" deep.

Figure 3:
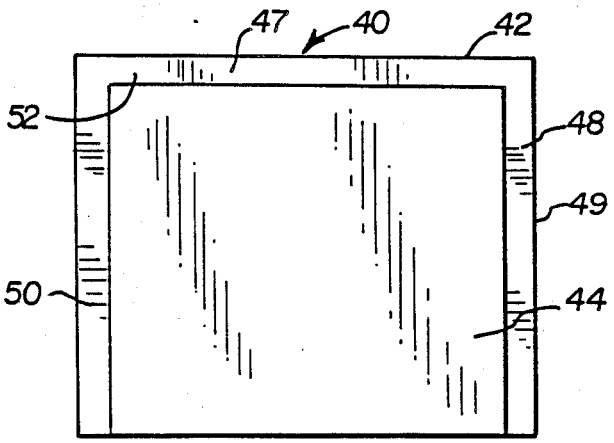
FIG. 3 shows a back view of the panel.
Figure 4:
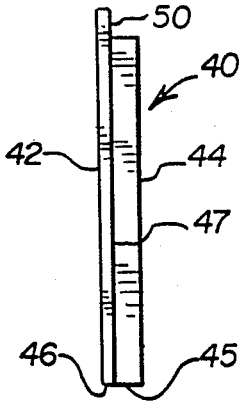
FIG. 4 is a side view of the panel.
Figure 2:
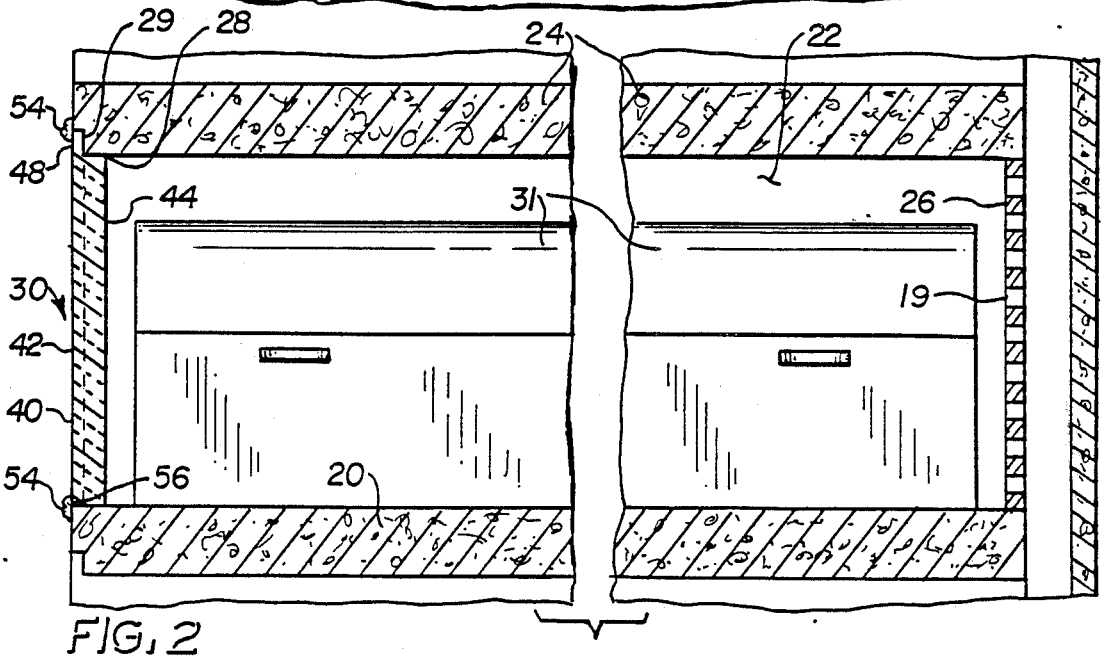
FIG. 2 shows a side view of a crypt and a panel partially in section.

FIG. 2 shows a cross-sectional view of a sealed crypt 30 occupied by a casket 31. A rectangular shaped panel 40 seals open front 28 of crypt 30. Panel 40, shown in more detail in FIGS. 3 and 4, includes a rectangular shaped front faced section 42 and an integral smaller rectangular shaped rear faced section 44. A geometric plane contains both a bottom edge 45 of rear faced section 44 and a bottom edge 46 of front faced section 42. Further, an inner face 47 of front faced section 42 and rear faced section 44 form a three sided U-shaped lip 48. Lip 48 has two legs 49, 50 and a base 52, each having equal widths of preferably ¾". When placing panel 40 over crypt open front 28, offset 29 receives lip 48 so that panel 40 is properly aligned with respect to crypt 30, front faced panel 42 faces outwardly toward mausoleum aisle 8 and back faced panel 44 faces inwardly toward casket 31. Typically, front faced panel 42 dimensions are 33"×27"×½" and the rear faced panel 44 dimensions are 30"×25"×1.5". Accordingly, the majority of panel 40 is 2" thick.

Panel 40 must be a good insulator and must be made of a material impervious to moisture, i.e. one which is hydrophobic, so that odors emanating from the casket do not become absorbed by it. Preferably, panel 40 should be made of closed cell polyurethane foam, although phenolic foam will work. Preferably, the polyurethane foam is freon based. It cannot be water based because water affects the insulation properties of the foam, although small amounts of water are permissible so that a fumigant or perfume can be mixed with the foam. Preferably, panel 40 has at least 85% closed cells, and most preferably it has between 90%–93% closed cells. Further, the R value of a 2' thick panel 40 should be preferably between 7–14 so that the panels can adequately insulate the mausoleum aisles 8.

To install panel 40 after placing casket 31 into crypt 30, one first can apply a continuous bead of non-water soluble sealant 54 (preferably silicon based, such as RTV® brand sealant, manufactured by General Electric Corporation) about the periphery of either crypt offset 29 and adjacent crypt floor section 20 or the periphery of panel lip 48 and adjacent panel edges 45, 46. Then panel 40 is placed over crypt open front 28 with lip 48 received by the offset 29 so that panel 40 adheres thereto. Then, when sealant 54 cures an insulated seal forms between crypt 30 and mausoleum aisle 8. Finally, a concrete or marble facing can be received by offset 29 and placed over the panel 40, and then mounted to crypt 30.

Figure 5:
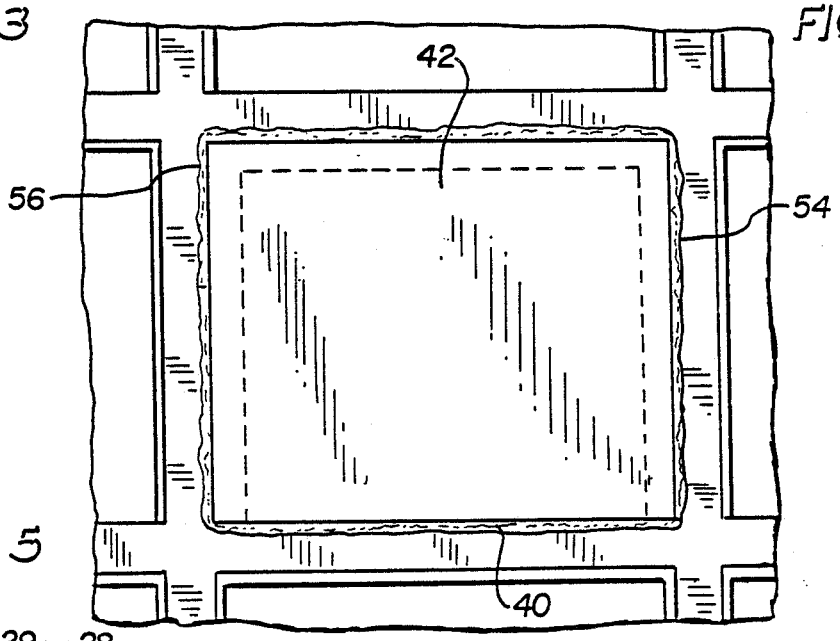
FIG. 5 shows a partial front view of the crypt tier having a panel mounted on a crypt.

An alternative method to attach panel 40 to the crypt 30 is to first place panel 40 over crypt open front 28, with lip 48 received by the offset 29. Then apply sealant 54 about a panel/crypt interface 56, as shown in FIG. 5, and thereby forming a seal between crypt 30 and mausoleum aisle 8.

A most preferred method of sealing crypt 30 is to first place panel 40 over crypt open front 28 with lip 48 received by offset 29, and then spraying a non-water based polyurethane foam sealant, which can be the same as that used for making the panel 40, about interface 56. When cured, the foam and panel 40 forms a water tight, hydrophobic seal between the inside of crypt 30 and mausoleum aisle 8.

One particular polyurethane foam that has worked well in the above-described panels and sealant is Isofoam® R-1143, a two component polyurethane foam supplied by Polycoat Systems, Inc., 79 North Industrial Park, Sewickley, Pa. 15143. It has low temperature and high temperature dimensional stability (within temperature ranges of −30° F. to 150° F.). Typically, a panel made of this foam will have a density of two pounds per cubic foot and have a R value of approximately 7 per inch. No matter which polyurethane foam is used, it is preferable to have one that gives a panel density of 1.5 to 4 pounds per cubic foot and an R value of 6 to 10 per inch. As stated previously, small amounts of water may be added to the foam to dissolve fumigants or perfumes.

Further, unoccupied crypts can be sealed by panels 40 in the above described method with or without any sealant. This will insulate mausoleum aisle 8 and reduce utility costs drastically.

If one should have to enter a crypt having panel 40 attached thereto, either to remove a casket or place a casket in a sealed empty crypt, one only has to remove any cover plate and cut about a perimeter of panel 40. Panel 40 can then be sealed together by replacing the removed panel portion and using the above described sealant or polyurethane foam to seal it to the panel portion that remained attached to crypt 30.

It is believed that the use of the above-described panel 40 in mausoleums will save energy costs on the order of 40% per year. Further, the existing panel can be retrofitted into an existing mausoleum structure easily by removing the present concrete or marble facing attaching panel 40 to the front of the crypt in the above described manner and then replacing the facing to the front of the crypt.

Having described the presently preferred embodiments of the invention, it is to be understood that it may otherwise be embodied with the scope of the appended claims.

I claim:

1. An improvement in combination with a plurality of horizontal and vertical walls arranged to provide open front crypt tiers in side-by-side relationship, said improvement comprises:

a closed cell hydrophobic insulation panel for covering the open fronts of the crypts, said insulation panel for covering the open fronts of the crypts, said insulation panel having an R value of at least 6 per inch of panel thickness; and means for attaching said panel to the crypts and over the open front of the crypts.

2. The improvement of claim 1, wherein said insulation panel comprises polyurethane foam.

3. The improvement of claim 1, wherein said insulation panel comprises phenolic foam.

4. The improvement of claim 1, wherein said means for attaching said panel to the open front of the crypt comprises a water proof sealant.

5. The improvement of claim 4, wherein said sealant comprises a silicon based sealant or a closed cell polyurethane foam.

6. The improvement of claim 2, wherein said polyurethane foam comprises at least 85% closed cells.

7. The improvement of claim 6, wherein said polyurethane comprises at least 90% closed cells.

8. The improvement of claim 6, wherein said polyurethane foam comprises a range of 90% to 93% closed cells.

9. The improvement of claim 8, wherein said panels have an R value range between 7 to about 14.

10. The improvement of claim 1, wherein said panel includes a lip about a partial perimeter of said panels, said lip received by a front of a crypt so that said panels can be aligned thereover.

11. An improvement in combination with a plurality of horizontal and vertical walls arranged to provide open crypt tiers in side-by-side relationship, said improvement comprises:

a closed cell polyurethane foam panel with an outer perimeter having a lip about a partial perimeter of said panels, said panel attached to the crypt and over the open front of the crypt by closed cell polyurethane foam.

12. A process of sealing a crypt of a mausoleum where the mausoleum has a plurality of horizontal and vertical walls arranged to provide open front crypt tiers in side-by-side relationship, said process including the steps of:

(a) forming a closed cell hydrophobic insulation panel for covering the open faces of the crypts; said insulation panel having an R value of at least 6 per inch of panel thickness;

(b) placing said panel over an open front face of a crypt; and (c) attaching said panel to said crypt and over the open face of the crypt by forming a hydrophobic seal at the interface of the open crypt face and said panel.

13. The process of claim 12, wherein said panel comprises closed cell polyurethane foam.

14. The process of claim 12, wherein said insulation panel comprises phenolic foam.

15. The process of claim 12, wherein said panel is attached to said open face of said crypt using water proof sealant.

16. The process of claim 15, wherein said sealant comprises a silicon based sealant.

17. The process of claim 13, wherein said panel is attached to said open face of said crypt by spraying closed cell polyurethane foam about an outer perimeter of said panel and onto said crypt so that said panel adheres thereto.

18. A process of sealing a crypt of a mausoleum where the mausoleum has a plurality of horizontal and vertical walls arranged to provide open front crypt tiers in side-by-side relationship, said process including the steps of:

(a) placing a panel made of closed cell polyurethane over an open face of a crypt; and (b) spraying closed cell polyurethane foam about an outer perimeter of said panel and onto the crypt so that said panel adheres to the crypt and forming a hydrophobic seal at an interface of the crypt front face and said panel.

19. A panel to be used in combination with a plurality of horizontal and vertical walls arranged to provide open crypt tiers in side-by-side relationship comprising:

a closed cell hydrophobic insulation panel having an R value of at least 6 per inch of panel thickness.

20. The panel of claim 19, wherein said panel is polyurethane foam or phenolic foam.

21. The panel of claim 19, wherein said panel further includes a fumigant.

22. The panel of claim 20, wherein said panel further includes a perfume.

23. The panel of claim 20, wherein said panel comprises at least 85% closed cells.

24. The panel of claim 20, wherein said panel comprises a range of 90%–93% closed cells.

25. The panel of claim 19, wherein side panel has an R value range between 7 to about 14.

26. An improvement in combination with a plurality of horizontal and vertical walls arranged to provide open front crypt tiers in side-by-side relationship, said improvement comprises:

a closed cell hydrophobic phenolic insulation panel for covering the open fronts of the crypts; and means for attaching said panel to the crypts and over the open front of the crypts.

27. A process of sealing a crypt of a mausoleum where the mausoleum has a plurality of horizontal and vertical walls arranged to provide open front crypt tiers in side-by-side relationship, said process including the steps of:

(a) forming a closed cell hydrophobic phenolic foam insulation panel for covering the open faces of the crypts;

(b) placing said panel over an open front face of a crypt; and (c) attaching said panel to the crypt and over the open face of the crypt by forming a hydrophobic seal at the interface of the open crypt face and said panel.

28. A process of sealing a crypt of a mausoleum where the mausoleum has a plurality of horizontal and vertical walls arranged to provide open front crypt tiers in side-by-side relationship, said process including the steps of:

(a) forming a closed cell, hydrophobic insulation panel for covering the open faces of the crypts;

(b) placing said panel over an open front face of a crypt; and (c) attaching said panel to the crypt and over the open face of the crypt by spraying closed cell polyurethane foam about an outer perimeter of said panel and onto said crypt so that said panel adheres thereto, forming a hydrophobic seal at the interface of the open crypt face and said panel.

* * * * *

UNITED STATES PATENT AND TRADEMARK OFFICE

CERTIFICATE OF CORRECTION

PATENT NO. : 4,928,447

DATED : May 29, 1990

INVENTOR(S) : Walter Stoecklein

It is certified that error appears in the above-identified patent and that said Letters Patent is hereby corrected as shown below:

Column 4, line 27, after "crypts," delete --said insulation panel for covering the open fronts of the crypts,--.

Signed and Sealed this

Second Day of July, 1991

*Attest:*

*Attesting Officer*

HARRY F. MANBECK, JR.

*Commissioner of Patents and Trademarks*